United States Patent [19]

Link et al.

[11] 4,123,321

[45] Oct. 31, 1978

[54] REMOVABLE HEAD BOX FOR A PAPER MAKING MACHINE

[75] Inventors: Christoph Link; Robert Trondle, both of Ravensburg, Germany

[73] Assignee: Escher Wyss GmbH, Ravensburg, Germany

[21] Appl. No.: 810,939

[22] Filed: Jun. 29, 1977

[30] Foreign Application Priority Data

Jul. 6, 1976 [CH] Switzerland ..... 8624/76

[51] Int. Cl.[2] ..... D21F 1/02

[52] U.S. Cl. ..... 162/272; 162/336; 162/343

[58] Field of Search ..... 162/272, 199, 336, 212, 162/343, 216

[56] References Cited

U.S. PATENT DOCUMENTS

| | | | |
|---|---|---|---|
| 3,373,080 | 3/1968 | Appel et al. | 162/343 |
| 3,943,035 | 3/1976 | Stotz et al. | 162/272 |

*Primary Examiner*—Richard V. Fisher

*Attorney, Agent, or Firm*—Kenyon & Kenyon, Reilly, Carr & Chapin

[57] ABSTRACT

The distribution pipe and pulp guide of the head box are mounted in a box-shaped support which is rotatable within two annular bearings. The support may be rotated so as to move the pulp guide from a horizontal plane into a vertical plane, for example for cleaning purposes. In addition, the distribution pipe is removably secured to the frame so as to be moved out of the support for cleaning purposes.

9 Claims, 4 Drawing Figures

Fig. 3
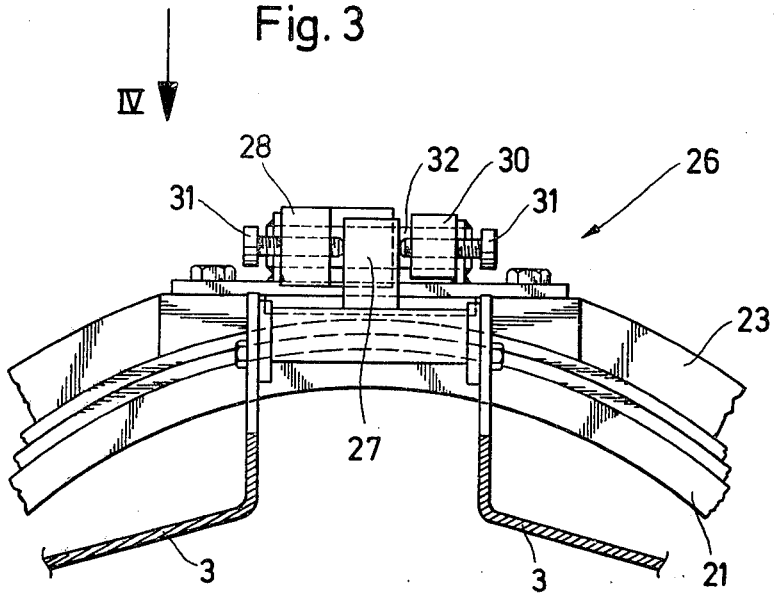
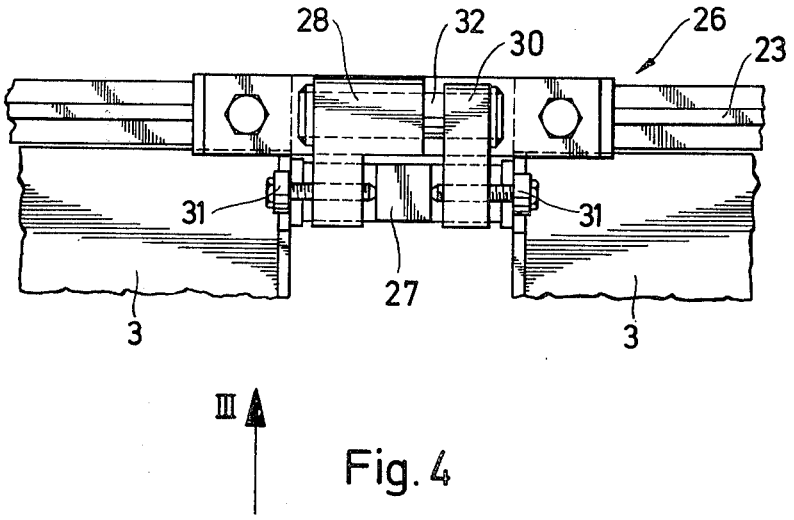
Fig. 4

REMOVABLE HEAD BOX FOR A PAPER MAKING MACHINE

This invention relates to a head box for a paper making machine. More particularly, this invention relates to a movable head box for a paper making machine.

As is known, the head box or breast box of a paper making machine is generally constructed with a distribution pipe which is connected to a source of pulp liquid (stock) and with a pulp guide which is constructed to uniformly distribute the stock onto a permeable element to form a non-woven web. Such boxes are known, for example from Swiss Pat. No. 518,406. Generally, such head boxes are of a stationary construction with the distribution pipe and pulp guide arranged in a horizontal plane for dispensing of the stock onto a horizontally disposed permeable element such as a suction drum. As a result, cleaning of the distribution pipe and pulp guide, as such becomes necessary from time-to-time, has been difficult. Similar difficulties arise when it becomes necessary to otherwise service the distribution pipe as the entire head box must be disassembled.

Accordingly, it is an object of the invention to provide a head box which can be readily disassembled for cleaning and servicing purposes.

It is another object of the invention to provide a compact construction which permits the distribution pipe of a head box to be readily removed for cleaning purposes.

Briefly, the invention provides a head box for a paper making machine which comprises a distribution pipe, a pulp guide and a box-shaped support in which the pipe and pulp guide are mounted. The distribution pipe is constructed to receive a supply of pulp and is of narrowing cross section in the direction of pulp flow while the pulp guide is connected to the distribution pipe for uniformly distributing the flow of pulp from the pipe onto a permeable element in order to form a non-woven web. The box shaped support has a constant cross-section along a longitudinal axis and has the pipe and pulp guide housed therein.

The head box also includes a pair of annular bearings, each of which is secured to a respective end of the support, and a pair of bearing housings in which a respective annular bearing is rotatably mounted for rotation of the support with the distribution pipe and pulp guide therein. This bearing arrangement allows the support to be rotated through 360° so as to locate the pulp guide in any position required. For example, the support may be rotated to dispose the pulp guide in a horizontal position for dispensing pulp onto a permeable element or to dispose the pulp guide in a vertical position for cleaning of the pulp guide and pipe.

In addition, the distribution pipe is removably secured to the pulp guide and has an outer periphery which is of less dimension than the inner diameter of each annular bearing so as to permit passage of the pipe through each annular bearing. In this regard, the pipe has an annular flange at one end for securement to a pipeline supplying pulp. This flange is also of less dimension than the inner diameter of the annular bearings so that upon detachment of the pipe from the supply pipeline, the pipe can be pulled through the annular bearings. For this purpose, the annular flange and the annular bearing have a common axis.

In order to facilitate removal of the distribution pipe from the support, a track rail is provided in the support for supporting the pipe during this movement.

In addition, a stop means is provided for selectively positioning the support circumferentially within the bearing housing. This stop means may thus be used to position the pipe guide in the horizontal position or the vertical position as noted above.

The pulp guide is generally constructed as a metal block which has a plurality of ducts for passage of the pulp from the distribution pipe. Further, this metal block is detachably secured to the support and to the distribution pipe. Thus, when the distribution pipe is to be removed from the support, the pipe is detached from the pulp supply pipeline and from the metal block. Thereafter, the pipe is lowered onto the track rail and run out of the support through the annular bearings.

By fastening the pulp guide in the support and separably fastening the distribution pipe to the pulp guide, a particularly advantageous arrangement is provided whereby the individual parts can be disassembled independently of each other. For example, the distribution pipe can be disassembled in order to permit cleaning of the pulp guide while the pulp guide remains in and is accessible from the support.

The invention thus provides a head box which is constructed as a universally useable structural unit which can be employed in different types of paper making machines regardless of the flow direction of the emerging jet of stock. Further, the head box can be brought from an operating position into a position suitable for cleaning, e.g. a vertical position by simple rotation.

The stop means provide a simple means of setting the head box in the working position or the cleaning position without any need for special adjustment efforts.

These and other objects and advantages of the invention will become more apparent from the following detailed description and appended claims taken in conjunction with the accompanying drawings in which:

FIG. 3 illustrates a partial cross-sectional view taken on line III—III of FIG. 1 of a stop means in accordance with the invention; and FIG. 4 illustrates a head view of the stop means illustrated in FIG. 3.

Figure 1:
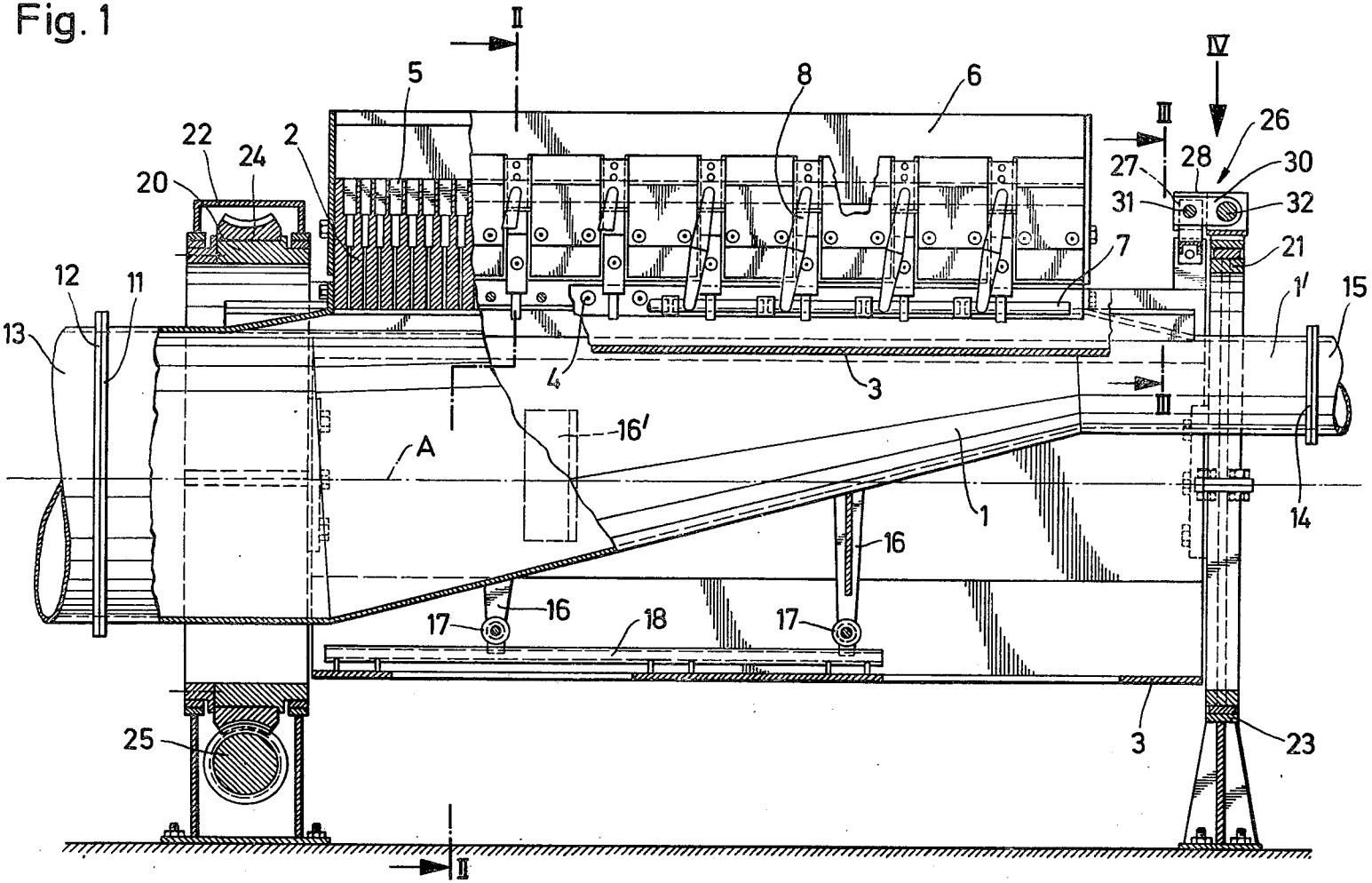
FIG. 1 illustrates a longitudinal cross sectional view of a head box according to the invention.
Figure 2:
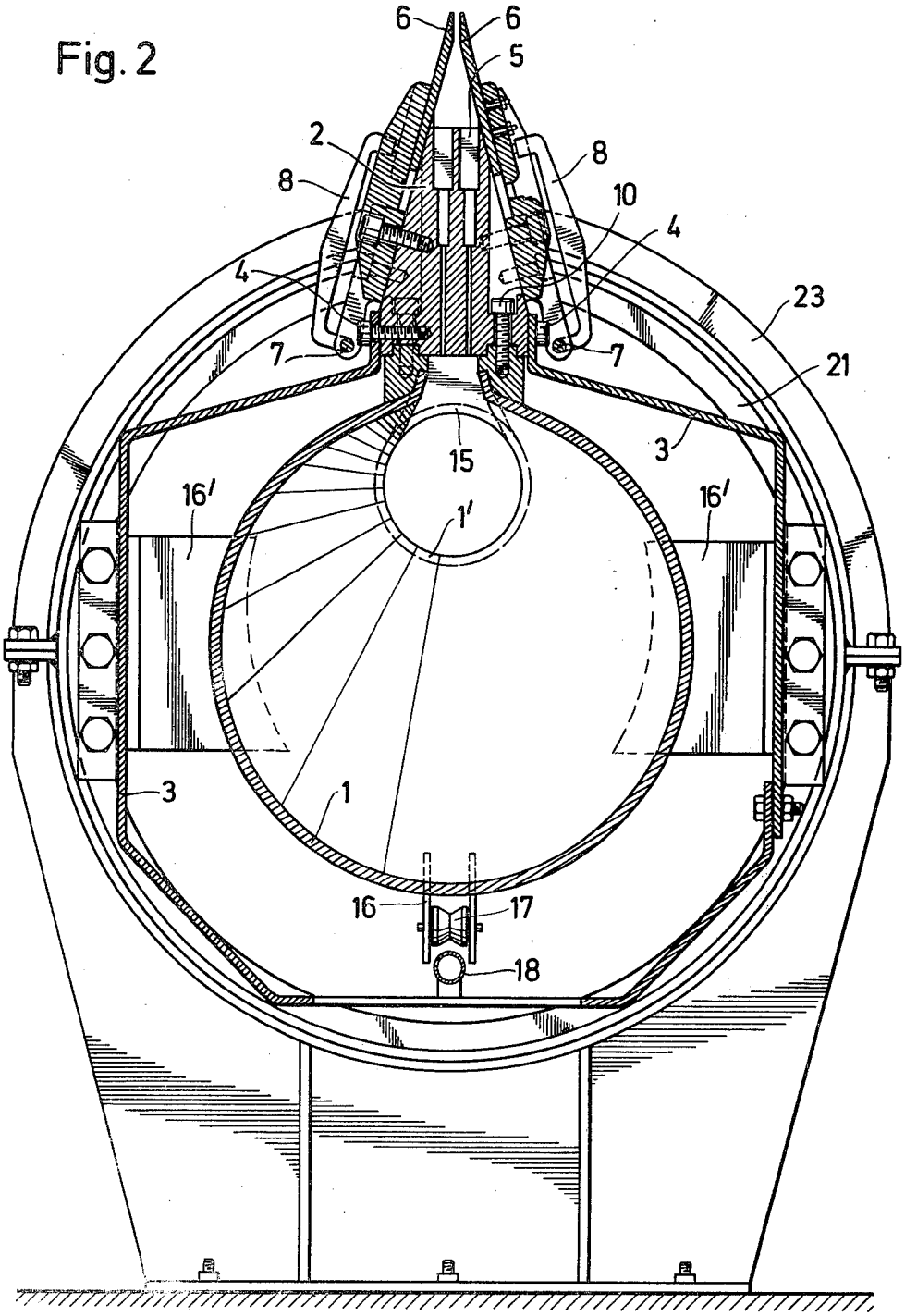
FIG. 2 illustrates a view taken on line II—II of FIG. 1.

Referring to FIGS. 1 and 2, the head box which is adapted for use with a paper making machine (not shown) contains a distribution pipe 1, a pulp guide 2 and a box-shaped support 3. As viewed in FIG. 2, the box-shaped support 3 has a constant polygonal cross-section along a longitudinal axis and can be fabricated, for example, of substantially flat or bent sheet metal plates which are bolted or welded together. As shown in FIG. 2, the support 3 has a pair of upstanding flanges, as viewed, which are disposed in parallel spaced apart relation.

The pulp guide is constructed in the form of a one piece metal block, for example as described in copending U.S. patent application Ser. No. 752,092 filed Dec. 20, 1976 now U.S. Pat. No. 4,087,321. In this regard, the pulp guide 2 is detachably secured to and between the flanges of the support 3 via threaded bolts 4. In addition, the pulp guide 2 is provided with parallel ducts 5 which are of increasing cross section in a stepwise manner in the direction of pulp flow therethrough. These ducts 5 serve to guide, distribute and impart uniform turbulence to the pulp passing therethrough from the distribution pipe 1.

The pulp guide 2 is also equipped with adjustable guide plates 6 for the pulp liquid. These plates 6 are adjusted via adjusting rods 7 and connecting levers 8 in a manner similar to that described in copending U.S. patent application Ser. No. 760,959, filed Jan. 21, 1977.

As shown in FIG. 2, the distribution pipe 1 is removably secured to the pulp guide 2 by threaded bolts 10. Also, as shown in FIG. 1, the distribution pipe 1 has a connecting flange 11 at one end which is secured to a flange 12 of a pipe line 13 for supplying pulp. At the opposite end of the distribution pipe 1 has a cylindrical extension 1' which is connected to a flange 14 of an overflow line 15.

A means is also provided for movably mounting the pipe 1 in the support 3. This means includes a plurality of legs 16 on the underside of the pipe 1 which support rollers 17 in vertical alignment over a track rail 18 which is secured at the base of the support 3. As shown in FIG. 2, the rollers 17 are spaced slightly above the track rail 18 and, more specifically, at such a distance that the distribution pipe 1 can be lowered onto the track rail 18 when the bolts 10 are loosened and lifted from the track rail 18 by tightening of the bolts 10.

In order to support the distribution pipe 1 laterally within the support 3, support plates 16' are fastened in a suitable manner between the distribution pipe 1 and support 3.

As shown in FIGS. 1 and 2, the ends of the support 3 are secured in respective annular bearings 20, 21 which, in turn, are rotatably supported in annular bearing housing 22, 23. One annular bearing 20 is provided with a worm gear 24 which meshes with a worm 25 which is rotatably mounted within one of the bearing housings 22. This worm 25 is provided with a suitable drive (not shown). The annular bearings 20, 21, distributor pipe 1 and support 3 are thus rotatable about an axis of rotation A which is coincident with the axis of the flanges 11, 12 and supply pipe 13.

Referring to FIG. 1, a stop means 26 is provided for selectively positioning the support 3 circumferentially within the bearing housings 22, 23. To this end, the stop means includes a stop element 27 which is secured to the support 3 and which serves for exactly adjusting the vertical position of the head box with the ducts 5 of the pulp guide 2 in a vertical plane. This is normally the position in which the distributor pipe 1 can be run out of the support 3 so as to permit cleaning of the ducts 5 of the pulp guide 2. This stop means 26 can also be provided in another position for fixing the operating position of the head box. The stop element 27 may be abutted against a suitable abutment (not shown) on the bearing housing 23 for these positions.

Referring to FIGS. 3 and 4, the stop means 26 may also be provided with two additional stop elements 28, 30 on the bearing housing 23. As shown, these stop elements 28, 30 are each provided with an adjustment screw 31 and each is rotatable about a common pin 32 so as to be swung out of the path of motion of the stop element 27, if necessary. In this manner, it is possible for the stop element 27 to approach the stop element 28, 30 from one side or the other.

In order to prepare for operation, the head box is brought into a desired operating position by a rotation of the worm 25. At this time, the stop means 26 can be used to effect the positioning of the head box. When the distribution pipe 1 is secured to the supply pipe 13 via the flanges 11, 12, operation can start.

If the head box and, in particular, the pulp guide 2 are to be cleaned, the flanges 11, 12 and 14, 15 are detached from each other after the pulp supply is interrupted and the pipe lines drained. Thereafter, the head box can be brought into a vertical position (as shown) by turning the worm 25 until the stop means 26 is engaged.

If the head box is in the vertical position as shown in FIGS. 1 and 2, the distribution pipe 11 with the rollers 17 can be lowered onto the track rail 18 by loosening of the bolts 10. Thereupon the distribution pipe together with the flange 11 can be pulled out of the support 3 to the right as viewed in FIG. 1. For this purpose, the outer periphery of the pipe 1 and particularly the flange 11 has a less dimension than the inner diameter of each of the annular bearings 20, 21 to permit passage of the pipe 1 through each bearing 20, 21. During this time, the pulp guide 2 with the ducts 5 remains fastened to the support 3. Thus, the ducts 5 can be cleaned either from the head or from the bottom, i.e. from within the support 3.

After cleaning, the distribution pipe 1 is run back into the support 3 and arranged underneath the pulp guide 2. Next, the distribution pipe 1 is lifted off the track rail 18 via the bolts 10 and fastened to the pulp guide 2.

If the pulp guide 2 must be disassembled, for example for cleaning or servicing outside of the head box, the bolts 4 are loosened so that the pulp guide 2 can be detached from the support 3. Assembly of the pulp guide within the support 3 is carried out in a reverse manner.

What is claimed is:

1. A head box for a paper making machine comprising a distribution pipe of narrowing cross-section in the direction of a flow of pulp therethrough;

a pulp guide connected to said pipe for uniformly distributing the flow of pulp from said pipe onto a permeable element to form a non-woven web;

a box-shaped support having a constant cross-section along a longitudinal axis thereof, said support having said pipe and said pulp guide housed therein;

a pair of annular bearings, each said annular bearing being secured to a respective end of said support; and a pair of bearing housings, each said housing having a respective annular bearing rotatably mounted therein for rotation of said support with said pipe and pulp guide therein.

2. A head box as set forth in claim 1 wherein said pulp guide is a metal block having a plurality of ducts extending therethrough for passage of pulp from said distribution pipe, said metal block being detachably secured to said support and to said distribution pipe.

3. A head box as set forth in claim 1 wherein each said annular bearing has a predetermined inner diameter, and said distribution pipe has an outer periphery of less dimension than said inner diameter of each said annular bearing to permit passage of said pipe through each said annular bearing.

4. A head box as set forth in claim 1 which further comprises a stop means for selectively positioning said support circumferentially within said bearing housings.

5. A head box as set forth in claim 1 wherein said pipe has an annular flange at one end, said flange and said annular bearings having a common axis.

6. A head box as set forth in claim 1 which further comprises means for movably mounting said pipe in said support along said axis.

7. A head box as set forth in claim 6 wherein said means includes a track rail in said support for supporting said pipe during movement of said pipe out of said support.

8. A head box for a paper making machine comprising a distribution pipe of narrowing cross-section in the direction of a flow of pulp therethrough;

a pulp guide connected to said pipe for uniformly distributing the flow of pulp from said pipe onto a permeable element to form a non-woven web;

a box-shaped support having a constant cross-section along a longitudinal axis thereof, said support having said pipe and said pulp guide housed therein; and means for movably mounting said pipe in said support along said axis.

9. A head box as set forth in claim 8 wherein said means includes a track rail in said support for supporting said pipe during movement of said pipe out of said support.

* * * * *